US006053206A

United States Patent [19]

Johannesen

[11] Patent Number: 6,053,206

[45] Date of Patent: Apr. 25, 2000

[54] DEVICE FOR CONTROLLING A LIQUID FLOW IN A CONDUIT SYSTEM

[76] Inventor: Jørgen Mosbæk Johannesen, 6, Hornum, DK-4600 Køge, Denmark

[21] Appl. No.: 09/068,967

[22] PCT Filed: Dec. 3, 1996

[86] PCT No.: PCT/DK96/00506

§ 371 Date: May 20, 1998

§ 102(e) Date: May 20, 1998

[87] PCT Pub. No.: WO97/21004

PCT Pub. Date: Jun. 12, 1997

[30] Foreign Application Priority Data

Feb. 4, 1995 [DK] Denmark ..... 1373/95

[51] Int. Cl.[7] ..... F15C 1/16

[52] U.S. Cl. ..... 137/810; 137/813

[58] Field of Search ..... 137/813, 810, 137/811, 812, 808

[56] References Cited

U.S. PATENT DOCUMENTS

| | | | |
|---|---|---|---|
| 3,507,296 | 4/1970 | Fix et al. | 137/812 |
| 4,131,134 | 12/1978 | Lindberg | 137/813 |
| 4,206,783 | 6/1980 | Brombach | 137/813 |
| 4,679,595 | 7/1987 | Johannessen | 137/813 |
| 4,889,166 | 12/1989 | Lakatos | 137/813 |
| 5,052,442 | 10/1991 | Johannessen | 137/813 |
| 5,080,137 | 1/1992 | Adams | 137/813 |
| 5,640,988 | 6/1997 | Bereton | 137/813 |

FOREIGN PATENT DOCUMENTS

| | | |
|---|---|---|
| 457121 | 11/1988 | Sweden . |
| 2254938 | 10/1992 | United Kingdom . |
| 2141561 | 4/1994 | United Kingdom . |
| WO 9408146 | 4/1994 | WIPO . |

*Primary Examiner*—A. Michael Chambers
*Attorney, Agent, or Firm*—Browdy and Neimark

[57] ABSTRACT

The device comprises a housing (1) with a curved side wall, said housing forming a vortex chamber and having an inlet opening (2) and an outlet opening (3), means (15) being provided at the inlet opening (2) for fastening a flow controlling element (7), and which device comprises a discharge pipe (5) connected with the outlet opening (3) of the vortex chamber. In the discharge pipe (5) a by-pass is provided which may be closed by means of a closing member (11) and which has a flow capacity so dimensioned that it does not at expected maximum liquid pressure substantially exceed the flow capacity of the vortex chamber.

13 Claims, 8 Drawing Sheets

DEVICE FOR CONTROLLING A LIQUID FLOW IN A CONDUIT SYSTEM

Figure 1:
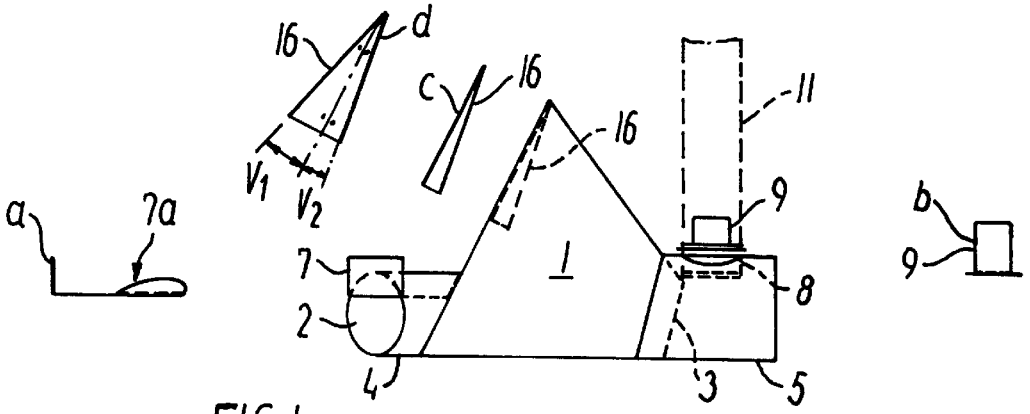

The present invention relates to a device for controlling a liquid flow in a conduit system like for instance a sewage system, which device comprises a housing with a curved side wall, said housing forming a vortex chamber and having an inlet opening and an outlet opening, means being provided at the inlet opening for fastening a flow controlling element, and which device comprises a discharge pipe connected with the outlet opening of the vortex chamber.

A device of this type is known from among others GB-A-2 141 561 and U.S. Pat. No. 5,052,442, in which, with a view to precision adjustment and change of capacity, an orifice is used for stepless variation of the inlet cross-section and thus the capacity.

Devices of this type are used in conduit systems which transport fluids containing more or less solid bodies and particles. The conduit system may comprise closed pipes or open gullies or combinations thereof like it is known from sewage systems, and tanks or other containers may be interposed in the conduit system.

There is on one hand a need for control of the amounts of flowing liquids, and on the other hand no clogging of devices or conduits must occur. To prevent depositing of solids and particles, no constrictions should be present in the through flow area, and if a constriction cannot be avoided, the flow rate must always be high around the place in question.

When a device with a vortex chamber is used for controlling the flow, the well-known effect is obtained that small liquid flows run unimpededly through the vortex chamber, whereas bigger liquid flows are braked due to the fact that the flow in the vortex chamber forms a spiral around an air column which partially bars the outlet opening, and at the same time the flow exerts a considerable centrifugal force against the inlet, such that a big hydraulic resistance against through flow is created without any physical change of the inlet or outlet openings of the vortex chamber.

In other words, when it is a question of controlling moderate and smaller amounts, control may take place with little risk of clogging. There is, however, still a risk of clogging, and the wish to be able to control even smaller amounts, increases this risk. If the device is mounted under water, it is difficult to remove a blockage. There is therefore an increasing wish for a possibility of emptying a certain room, in which the device is mounted, without overloading the downstream parts of the system, such as conduit systems, pump stations, sewage disposal plants and/or oil separators.

From U.S. Pat. No. 4,889,166 it is known to provide a device of the type in question with a closure which gives access to the interior of the device and a possibility of removing a blockage in the inlet or the outlet from the device. As this device is mounted under water, it is still difficult to find a blockage with cleaning equipment, and to remove a blockage against the liquid pressure, if the outlet is blocked. Thus the closure in question does not constitute an actual by-pass which by opening ensures emptying of the system, if the outlet is blocked. It rather constitutes a cleaning access to the interior of the device.

It is known in practice to provide an overflow connector on top of the outlet pipe of a device of the type in question, and in this connector to place an upright pipe which partly may serve as an emergency overflow and partly when removed opens for emptying down to the upper edge of the connector. This combined emergency overflow/by-pass is placed after the outlet opening from the device and therefore ensures a possibility of emptying irrespective of whether inlet or outlet is clogged. These overflow connectors and pipes have up till now been manufactured in standard dimensions 75, 110 and 160 mm without consideration to capacity and in the known cases always with considerably bigger capacity than the vortex chamber. This entails a big risk of overloading the downstream parts of the system, such as conduit systems, pump stations, cleaning plants and/or oil separators when these emergency overflow/by-passes are activated.

The object of the present invention is to eliminate these drawbacks of the prior art.

The device according to the invention differs from the prior art in that in the discharge pipe a by-pass is provided which may be closed by means of a closing member and which has a flow capacity so dimensioned that it does not at expected maximum liquid pressure substantially exceed the flow capacity of the vortex chamber. The flow capacity of the by-pass is preferably substantially equal to the flow capacity of the vortex chamber. Hereby the desired possibility of emptying in case of clogging of the vortex chamber is obtained, irrespective of whether the clogging is positioned at its inlet or outlet, without any risk of overloading the downstream parts of the plant.

The flow controlling element may be an inlet block which causes a decrease of the flow capacity of the vortex chamber, or it may be an inlet flow smoothing member, which increases the flow capacity.

To ensure that there is a capacity coherence also in case that for instance a plane or angled plate is to be mounted later in order to reduce capacity, the overflow connector may be provided with an orifice member or a Bordas pipe, i.e. a short, vertical pipe of small dimension with a flange resting on the bottom of the connector, the connector having at least one flow opening of the same dimension as the interior diameter of the Bordas pipe. A Bordas pipe is preferred to an orifice member, because a liquid flow through a Bordas pipe is contracted more than a liquid flow through an orifice member, which means that with a Bordas pipe it is possible to obtain the same flow resistance with a bigger flow cross-section relative to an orifice member. This means a reduction of the risk of clogging. Furthermore, this risk is minimized by use of a Bordas pipe because it may extend above sewage sludge which may have deposited on top of the outlet pipe and which may fall down into the connector when the closing member is removed.

By the invention a given vortex chamber with a definite characteristic (flow capacity as function of the liquid pressure in front of the inlet) may by means of a flow controlling element which is mounted at the inlet have this characteristic changed into another definite characteristic. Thereby, a given vortex chamber may be adapted to a given use, and should conditions change later, a new, well defined adaptation may be made. This has the advantage that a smaller number of sizes of the devices may be manufactured and stored, and the advantage that by a change a definite, desired capacity is obtained with great certainty. Similar considerations apply to the by-pass.

The closing member may for instance have the shape of a plug or an upright pipe which may be open or completely or partially closed at the top. An open upright pipe may be divided in sections, each sections having at its upper end an inlet with a definite flow capacity and the individual sections being releasably connected with each other. A stepwise emptying may be performed by removing one section at a time as the water level gradually falls to next lower step.

In a preferred embodiment the inlet opening of the vortex chamber is rounded at the bottom and at the top defined by a straight, preferably horizontal edge. Thereby, the least possible surface facing the flow direction is obtained when the inlet has been placed in a gully and also the smallest possible risk of particles in the flow depositing around the inlet and forming a plug.

Finally, an outlet spout with an overflow connector may be fabricated separately, such that it is possible to remove the device without having to remove the encased outlet spout. The device is cone-shaped and therefore easier to dismount without spout.

Figure 2:
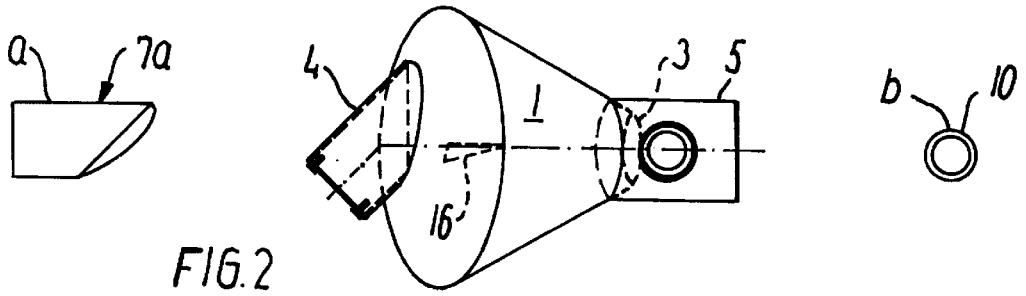
Figure 3:
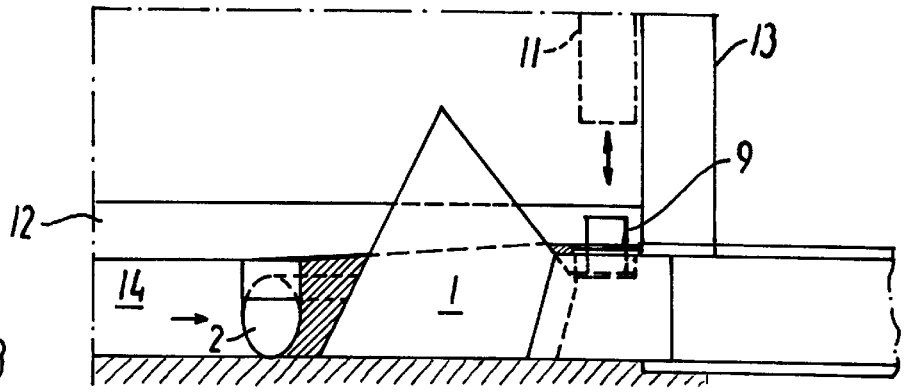
Figure 4:
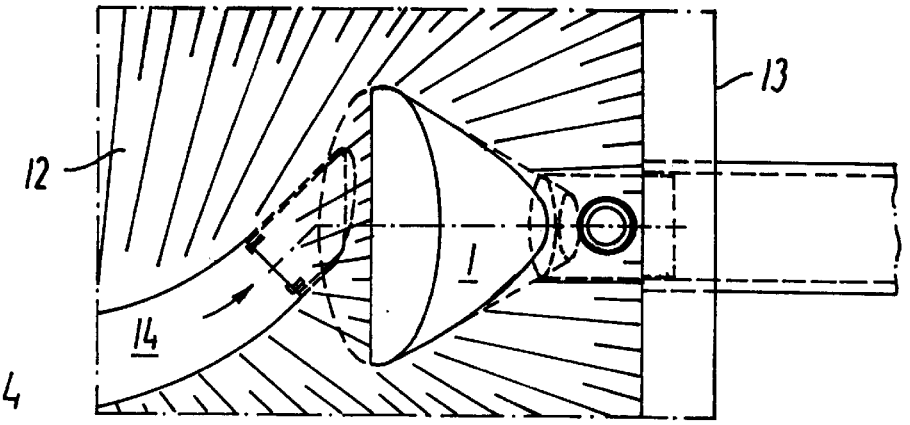
Figure 10:
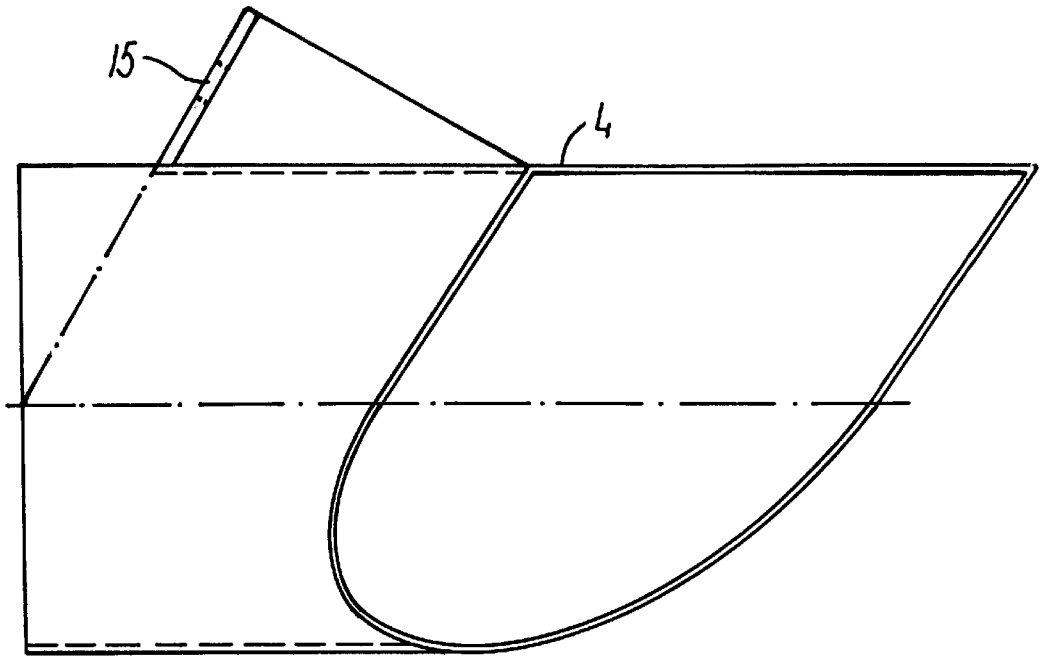
Figure 9:
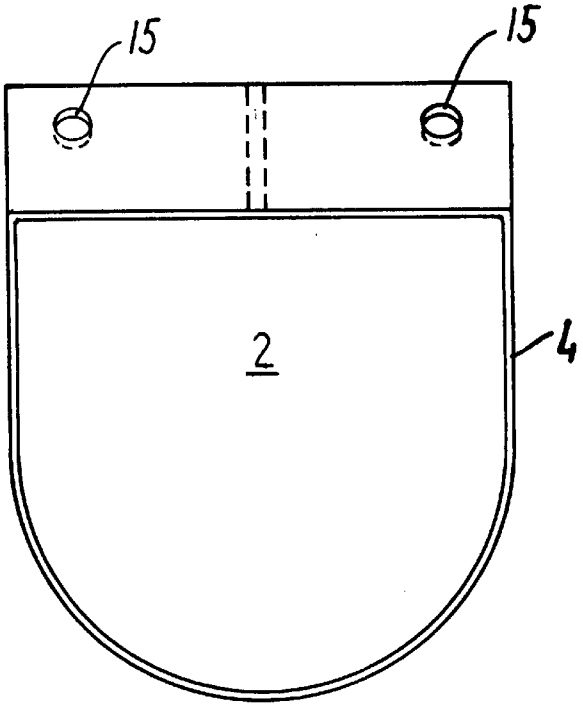
Figure 15:
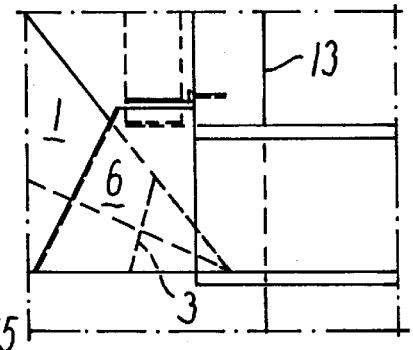
Figure 17:
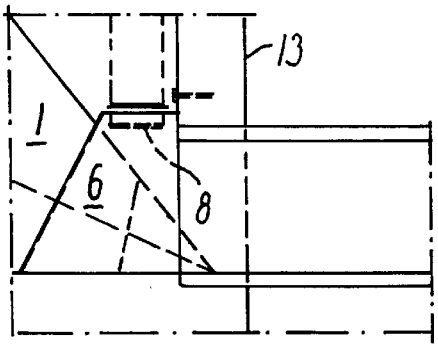
Figure 16:
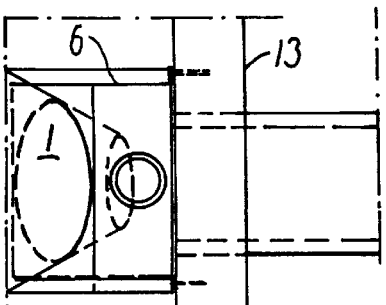
Figure 18:
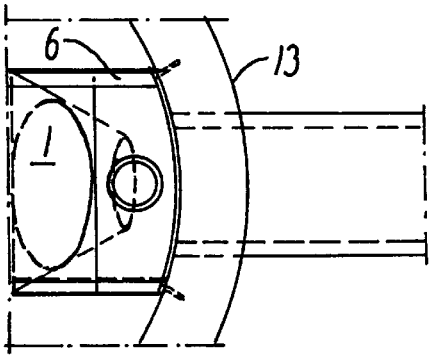

The invention will be explained in detail in the following by means of examples of embodiments with reference to the drawing, in which FIG. 1 shows a device according to the invention, seen from the side, a showing the orifice plate seen from the side, b the Bordas pipe seen from the side, c a bent member for establishing a damping edge in the vortex chamber, and d the member shown in c in unfolded condition, FIG. 2 the device in FIG. 1 seen from above, a showing the orifice plate seen from above and b the Bordas pipe seen from above, FIG. 3 the device in FIG. 1 mounted in the bottom of a well and connected with a discharge, parts of the bottom being removed, FIG. 4 the same as FIG. 3 seen from above, FIGS. 5–8 show the same as FIGS. 1–4 but in another embodiment of the inlet of the device, FIGS. 9 and 10 an inlet spout for the device in FIG. 5–8 seen from the front and from the side, respectively, FIGS. 11 and 12 a connection of the device according to the invention with a curved well wall, FIGS. 13 and 14 a connection of the device according to the invention with a curved well wall, FIGS. 15 and 16 a connection between the device according to the invention and a plane well wall, in which the device is connected with a box, which comprises the by-pass and is connected with the outlet from the well, FIGS. 17 and 18 a connection corresponding to the connection shown in FIGS. 15 and 16 but with a curved well wall, FIGS. 19 and 20 an embodiment of the invention, in which the device and the by-pass have been provided in separate elements with a view to the possibility of a later dismounting, and the by-pass is closed by a pipe divided into sections, FIGS. 21 and 22 a device according to the invention seen from the side and from above, respectively, with an inlet flow smoothing member mounted at the inlet, FIGS. 23 and 24 an embodiment of the device seen from the side and from above, respectively, in which longitudinal ribs have been provided in the outlet, FIG. 25 a view seen in the direction of the arrow XXV in FIG. 23, the housing of the vortex chamber being omitted, and FIG. 26 a lateral view of a device mounted at a place with limited over-head clearance.

The figures show a housing 1 known per se comprising a conical vortex chamber known per se and with an inlet 2 and an outlet 3. The inlet 2 is provided in an inlet spout 4, and the outlet discharges into a discharge pipe 5, which may be integral with the housing 1 or constituted by a separate member 6.

The inlet spout 4 is provided with means for fastening a flow controlling member 7 which may either have the shape of an orifice member 7*a* which partially bars the inlet 2 or an inlet flow smoothing member 7*b* which makes the inlet more streamlined (funnel-shaped).

The discharge pipe 5 is at its upper side provided with a by-pass in form of a connector 8 with a through-going hole adapted to receive a Bordas pipe 9 with a flange 10 which may rest on an interior collar in the lower end of the connector 8. The connector 8 is adapted to receive a closing member either in form of a plug or as shown in several figures, an upright pipe 11.

In FIGS. 3, 4, 7 and 8 the housing is shown embedded in the bottom (the banquette) 12 of a well with a side wall 13. A gully 14 in the bottom 12 leads to the inlet 2.

In FIGS. 1–4 the device is shown with a circular inlet spout, whereas in FIGS. 5–8 it is rounded at the bottom and flat at the top. FIGS. 9 and 10 show in detail the embodiment of the inlet spout 4 of the device shown in FIGS. 5–8 with thread holes 15 for mounting of an inlet flow controlling member 7.

Figure 5:
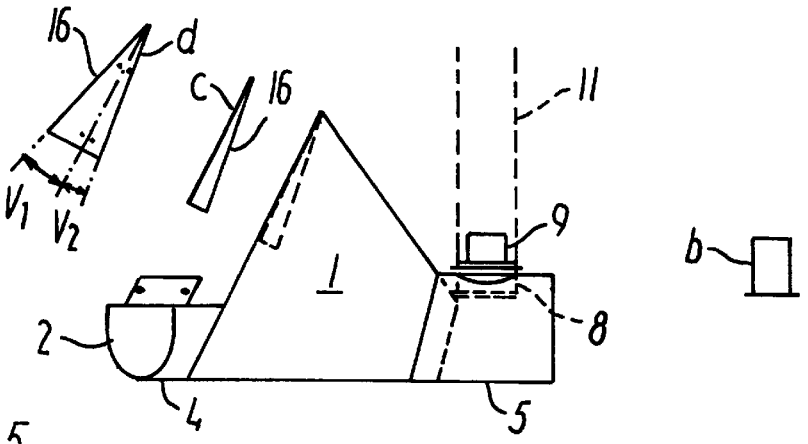
Figure 6:
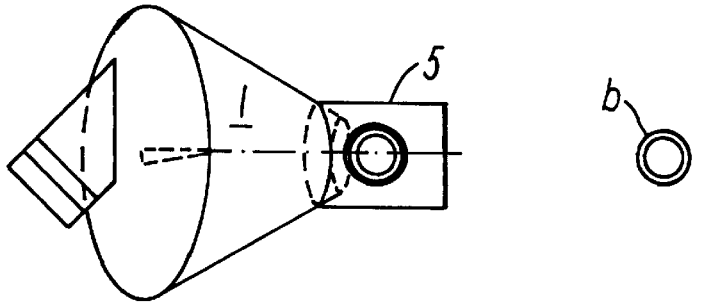
Figure 7:
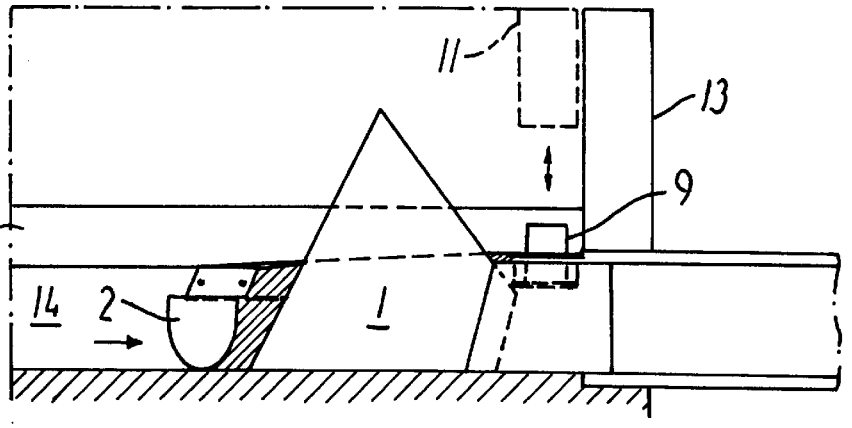
Figure 8:
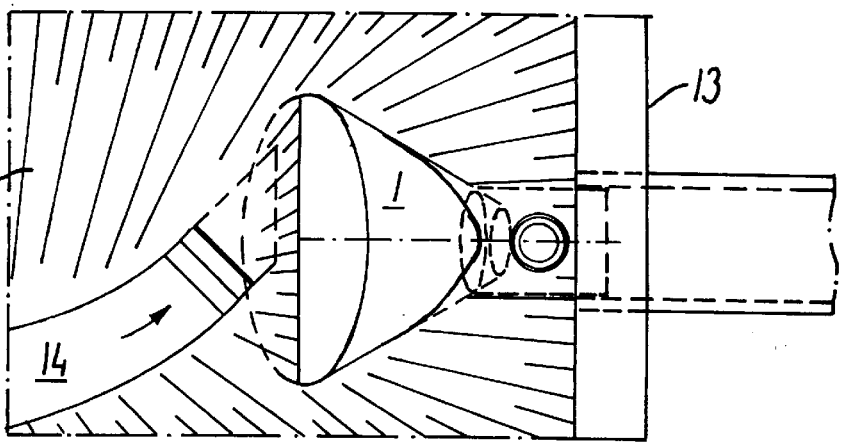

FIGS. 1, 2, 5 and 6 show another capacity controlling member than the inlet flow controlling member 7, viz. a bent member 16 which in FIGS. 1*d* and 5*d*, however, is shown unfolded. The bent member 16 may be mounted on the inner side of the flat end wall of the housing 1 as shown in FIGS. 1, 2, 5 and 6, whereby the member will dampen an eddy current in the vortex chamber and thus reduce its braking effect, the flow capacity increasing again.

Figure 21:
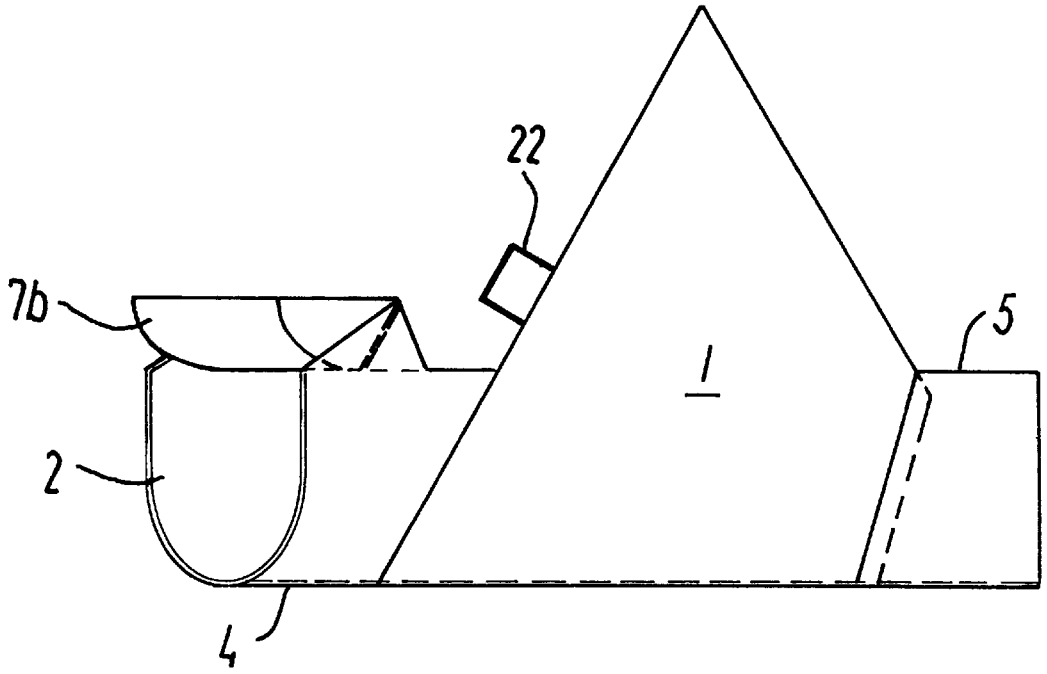
Figure 22:
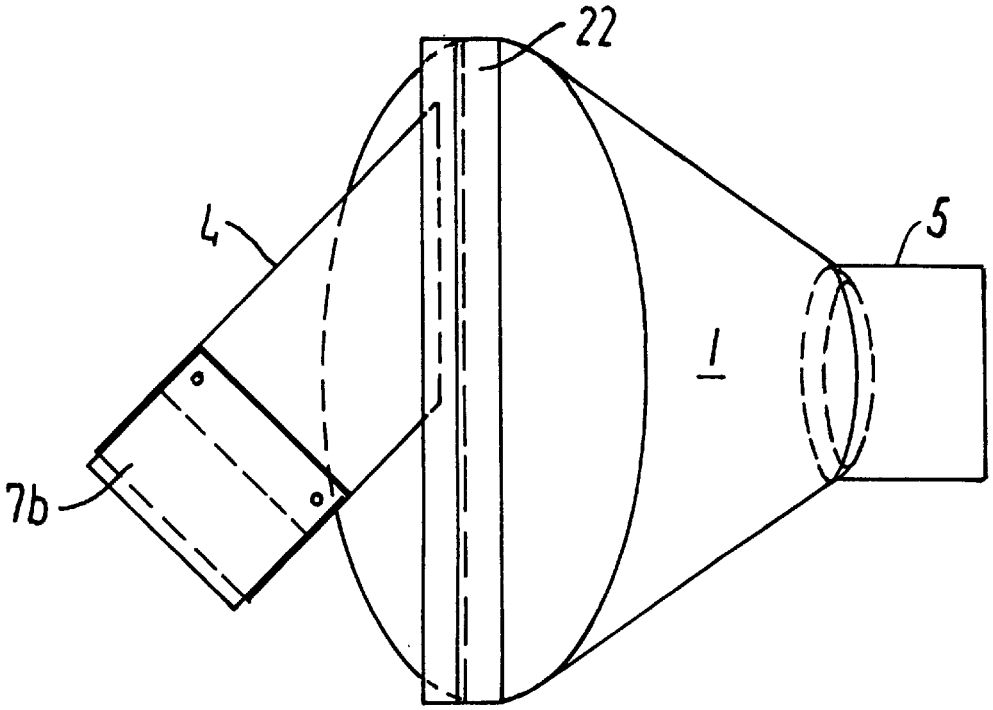

Another way of increasing the flow capacity of the vortex chamber is to establish an inlet flow smoothing member 7*b* as shown in FIGS. 21 and 22. Thereby the flow into the inlet spout 4 becomes more even and a contraction of the flow in the inlet spout 4 itself which would otherwise occur is avoided.

Figure 11:
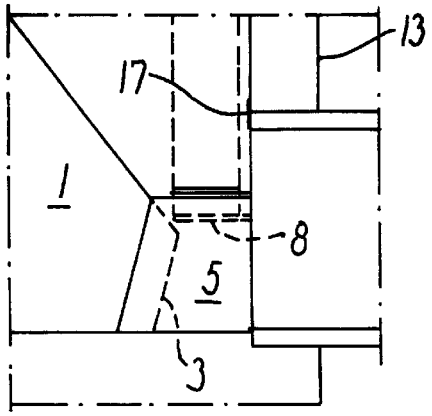
Figure 13:
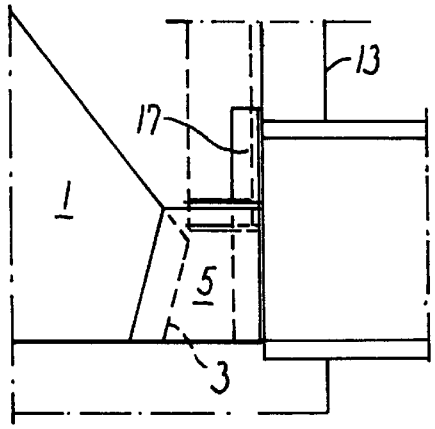
Figure 12:
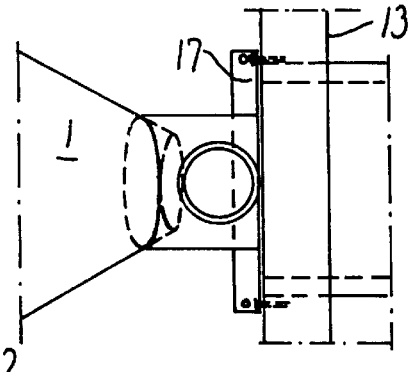
Figure 14:
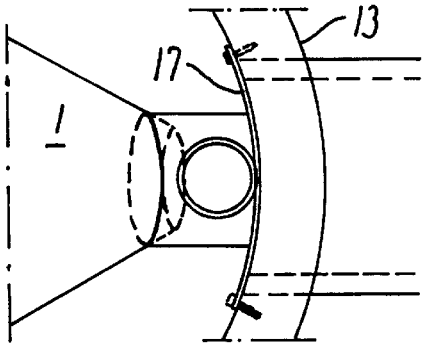

The discharge pipe 5 provided with the connector 8 may be integral with the housing 1, of which FIGS. 11 to 14 show examples, FIGS. 11, 12 showing an example, in which the discharge pipe 5 is connected with a plane side wall 13 and FIGS. 13 and 14 show an example, in which the discharge pipe 5 is connected with a curved side wall 13, in both cases by means of a flange 17 on the discharge pine 5.

FIGS. 15 to 18 show corresponding examples, in which the discharge pipe 5 is provided as a separate member 6, into which the end of the housing 1 is introduced.

Figure 19:
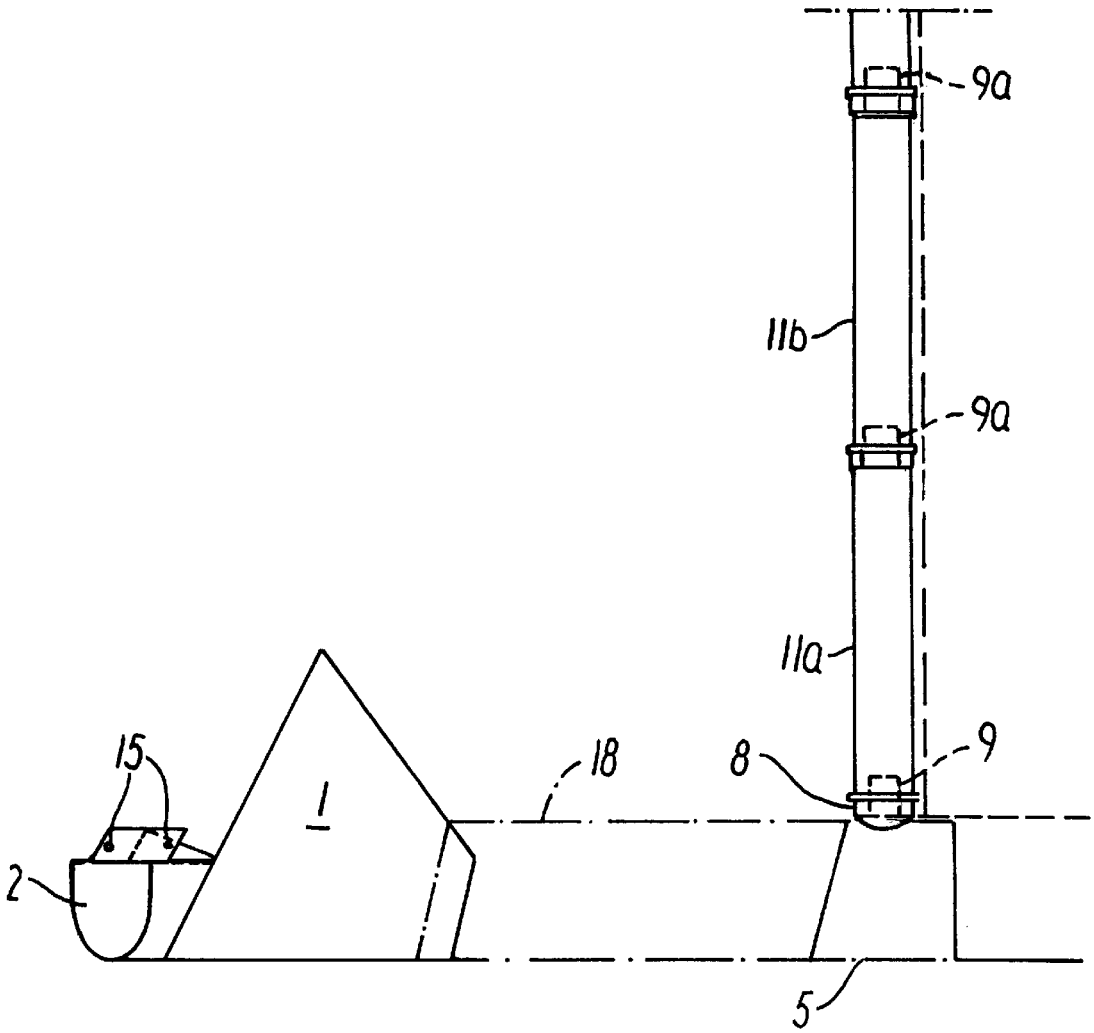
Figure 20:
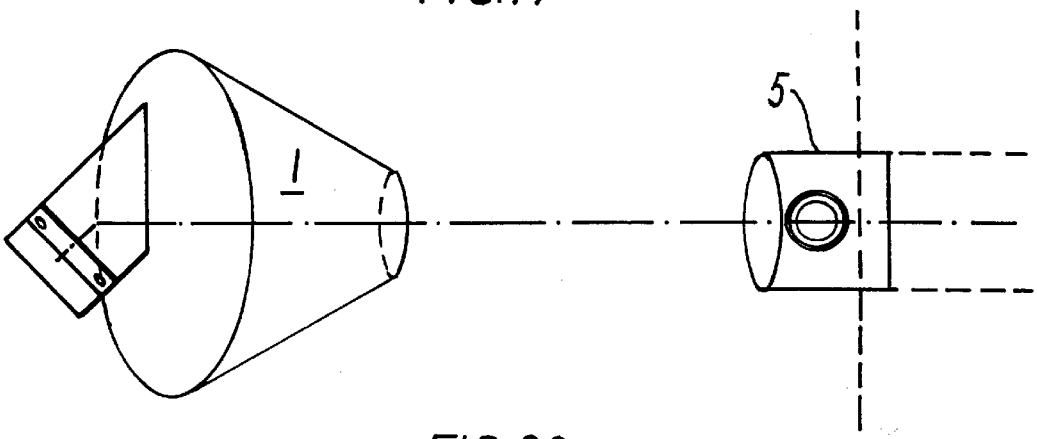

FIGS. 19 and 20 show schematically an example, in which the discharge pipe 5 provided with the connector 8 is positioned at a distance from the housing 1, these two members being connected by means of a pipe 18 indicated by a dot-and-dash line. Moreover, the upright pipe 11 is divided into sections 11*a*, 11*b*, 11*c*, and the sections 11*a* and 11*b* are at their upper end adapted to releasably receive a subsequent section and are more-over provided with a Bordas pipe 9*a*, such that the by-pass capacity obtained by removing the upright tube 11 may be controlled, as it differs depending on how many sections are removed. It is also possible to gradually empty the well by removing sections one by one. Thereby it becomes possible to approximate the capacity characteristic of the by-pass to that of the vortex chamber.

Figure 23:
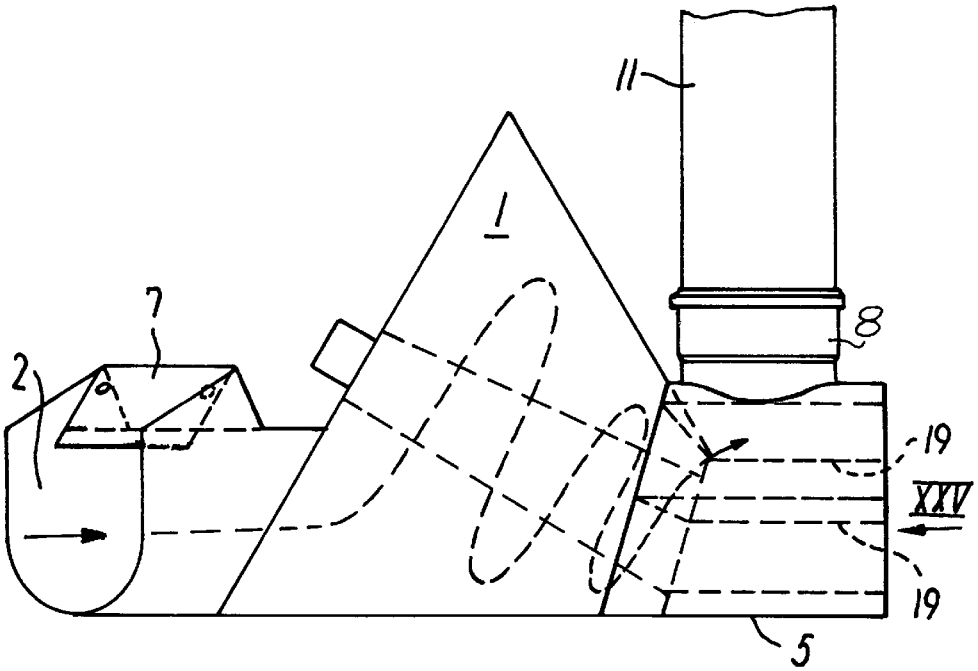
Figure 24:
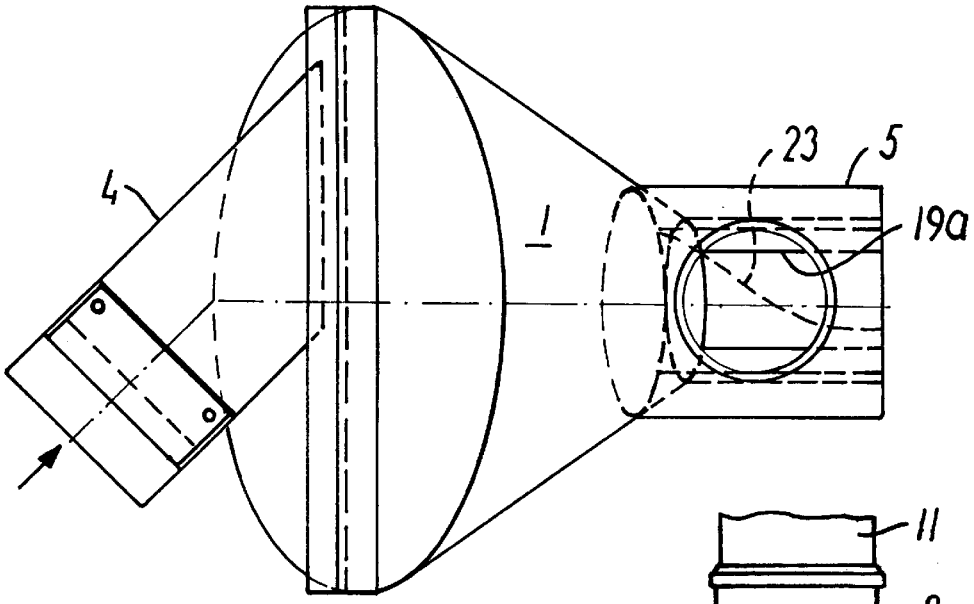
Figure 25:
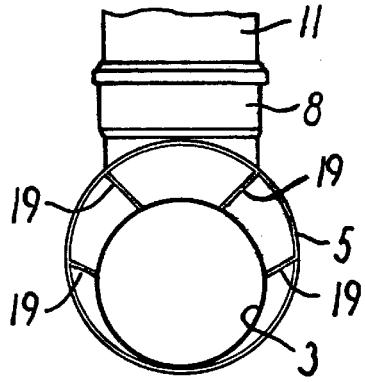

FIGS. 23–25 show an embodiment, in which the discharge pipe 5 is provided with longitudinal guide plates or ribs 19, which seen in cross-section (FIG. 25) extend from the interior periphery of the discharge pipe 5 to the circumference of the outlet 3 of the housing 1. Thereby a straightening of the otherwise helical flow out of the housing 1 is obtained. By providing a guide plate 19*a* immediately upstream of the connector 8 as seen in the direction of the vortex is obtained that the flow out of the housing 1 is "opened" as illustrated by the flow line 23 which indicates a border between air and fluid, whereby there is a possibility that air, in case the upright pipe 11 extends above the water level and is open at the top, may penetrate into the vortex chamber and thereby supplement the air column present in the middle of the chamber but likely to be sucked out with the outflowing fluid, which may reduce the braking effect of the vortex chamber.

Figure 26:
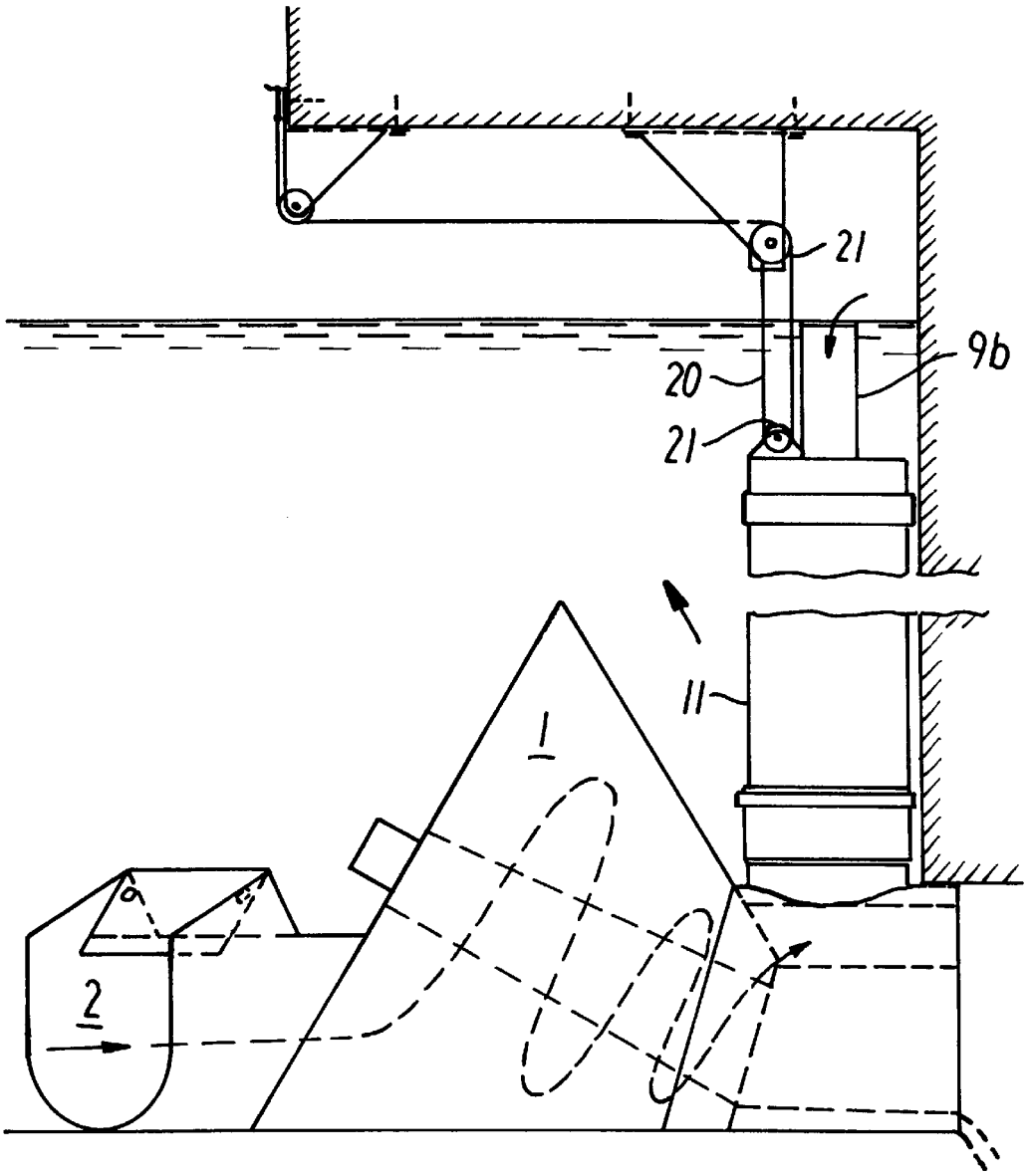

FIG. 26 shows a case, in which the device according to the invention is mounted in a well in a place, where the over-head clearance h is less than the maximum water level. The upright pipe 11 is therefore substantially closed, as only a narrow Bordas pipe 9*b* in the top of the pipe 11 allows a certain limited flow. In order to make it possible to remove the upright pipe 11, a cord drive 20 is provided which may be controlled from a place above the well. The cord drive is passed over reel wheels 21 to provide a gearing, as in this case a considerable water pressure may exist on the upper surface of the upright pipe 11, which thereby becomes very heavy. In the embodiments shown in FIGS. 21–26 the housing 1 is provided with a reinforcing rib 22 on the flat end wall.

By the present invention a possibility has been created of opening a by-pass with a flow capacity which by means of Bordas pipes 9 is adjusted in respect of flow capacity relative to the vortex chamber. Moreover, there is a possibility of changing the flow capacity of the vortex chamber by means of inlet controlling members 7 and/or the bent member 16. In correspondence with such a change of the flow capacity of the vortex chamber the flow capacity of the by-pass is changed by changing the Bordas pipe or pipes 9, 9*a*.

I claim:

1. A device for controlling a liquid flow in a conduit system like for instance a sewage system, which device comprises a housing (1) with a curved side wall, said housing forming a vortex chamber and having an inlet opening (2) and an outlet opening (3), means (15) being provided at the inlet opening for fastening a flow controlling element (7), and which device comprises a discharge pipe (5) connected with the outlet opening (3) of the vortex chamber, characterized in that in the discharge pipe (5) a by-pass is provided which may be closed by means of a closing member (11) and which has a flow capacity so dimensioned that it does not at expected maximum liquid pressure substantially exceed the flow capacity of the vortex chamber.

2. A device according to claim 1, characterized in that the flow capacity of the by-pass is substantially equal to the flow capacity of the vortex chamber.

3. A device according to claim 1, characterized in that the flow controlling element is an inlet block (7*a*).

4. A device according to claim 1, characterized in that the flow controlling element is a inlet flow smoothing member (7*b*).

5. A device according to claim 1, characterized in that the by-pass comprises a connector (8) with a flow opening, said connector (8) being adapted to releasably receiving an orifice member or a Bordas pipe (9) with an inner diameter which is equal to or less than the diameter of the flow opening of the connector (8).

6. A device according to claim 5, characterized in that the closure member is an upright pipe (11), which is open at its upper end, is adapted to be arranged over the Bordas pipe (9) and extends upwards to a predetermined height.

7. A device according to claim 6, characterized in that the upright pipe (11) is divided into sections, each section (11*a*, 11*b*) having at its upper end an inlet with a definite flow capacity, and that the individual sections are realisably connected with each other.

8. A device according to claim 1, characterized in that the closure member is a plug.

9. A device according to claim 1, characterized in that the closing member is an upright pipe which has a relative to the by-pass substantially tapering opening, for instance through a Bordas pipe, at its upper end.

10. A device according to claim 1, characterized in comprising a cord member (20) which possibly through a gear (21) connects the closing member (11) with the surroundings.

11. A device according to claim 1, characterized in that the vortex chamber has an end wall substantially perpendicular to the axis of the chamber and in that said end wall at its interior surface is provided with a protrusion, preferably in the form of a radial rib (16) to attenuate an eddy current created in the chamber.

12. A device according to claim 1, characterized in that the inlet opening (2) of the vortex chamber is rounded at the bottom and at the top defined by a straight, preferably horizontal edge.

13. A device according to claim 1, characterized in that the inner diameter of the discharge pipe (5) is bigger than the diameter of the outlet opening (3) of the vortex chamber and in that in the discharge pipe (5) baffles (19) extend in its longitudinal direction, said baffles extending in the cross-section of the discharge pipe outside the periphery of the outlet opening of the vortex chamber.

* * * * *